United States Patent [19]

Gierse et al.

[11] Patent Number: 4,858,843

[45] Date of Patent: Aug. 22, 1989

[54] FABRIC WEB DELIVERY APPARATUS

[75] Inventors: Franz J. Gierse, Siegen; Manfred Pabst, Cologne; Heinz Hermanns, Korschenbroich; Karl Ippers, Willich; Stephan Krenn, Monchen-Gladbach; Friedrich Huppe, Aachen; Carl H. Opgenoorth; Conrad Wolters, both of Monchen-Gladbach, all of Fed. Rep. of Germany

[73] Assignee: A. Monforts GmbH & Co., Fed. Rep. of Germany

[21] Appl. No.: 235,003

[22] Filed: Aug. 22, 1988

[30] Foreign Application Priority Data

Aug. 21, 1987 [DE] Fed. Rep. of Germany ..... 3727888

[51] Int. Cl.[4] ..... B65H 17/08

[52] U.S. Cl. ..... 242/65; 242/66; 242/67.1 R; 26/70

[58] Field of Search ..... 242/65, 66, 67.1 R, 242/75.1; 26/70, 1

[56] References Cited

U.S. PATENT DOCUMENTS

| | | | |
|---|---|---|---|
| 3,086,726 | 4/1963 | Aaron | 242/65 |
| 3,224,698 | 12/1965 | Conti | 242/67.1 R |
| 3,602,448 | 8/1971 | Muensterer | 242/67.1 R X |
| 3,792,824 | 2/1974 | Meyer et al. | 242/65 |
| 4,095,754 | 6/1978 | Campo | 242/65 |
| 4,343,440 | 8/1982 | Engl | 242/67.1 R |
| 4,360,170 | 11/1982 | Kuklies et al. | 242/67.1 R X |
| 4,450,887 | 11/1985 | Schonmeier | 242/65 X |
| 4,494,706 | 1/1985 | Becherer et al. | 242/65 |
| 4,601,435 | 7/1986 | Tomma et al. | 242/65 X |

FOREIGN PATENT DOCUMENTS

| | | | |
|---|---|---|---|
| 1307406 | 9/1962 | France | 26/1 |
| 0022241 | 2/1983 | Japan | 242/67.1 R |
| 0139947 | 8/1983 | Japan | 242/66 |
| 0113670 | 3/1918 | United Kingdom | 26/70 |

*Primary Examiner*—Stuart S. Levy
*Assistant Examiner*—John M. Eghtessad
*Attorney, Agent, or Firm*—Shefte, Pinckney & Sawyer

[57] ABSTRACT

A fabric web delivery apparatus is provided with a pivotable and vertically adjustable fabric delivery arm having a driven delivery roller at its outward end and also with an independently reciprocable cuttle arm enabling selective positioning of the delivery arm for disposition of the delivery roller alternatively for feeding a traveling fabric web to the cuttle arm for folding the web in pleats, or for peripheral driving contact with a fabric winding roll of a surface-driven fabric winder, or for guiding a traveling fabric web to a fabric winding roll of an axis-driven fabric winder, or for operation as a support roller for a fabric winding roll of a rising-type fabric winder.

6 Claims, 4 Drawing Sheets

FABRIC WEB DELIVERY APPARATUS

BACKGROUND OF THE INVENTION

The present invention relates to apparatus for delivering a traveling fabric web to a web-handling location for winding or folding of the web. More particularly, the present invention relates to a fabric web delivery apparatus of the type having a delivery arm pivotably mounted in a machine frame with a driven delivery roller supported at the free end of the delivery arm for use as a peripheral driving contact roller for a fabric winding roll of a surface-driven fabric winder.

Three basic types of fabric winding apparatus are in common conventional use. A surface-driven winder, or "Sochor" winder, utilizes a driven roller in peripheral driving contact with a fabric winding roll to drive the roll while applying a traveling fabric web peripherally thereto to wind the web about the roll. Such winders are commonly utilized for winding large batches of relatively stable woven fabrics. Since the drive of the fabric winding roll is carried out exclusively through the driven peripheral contact roller, the peripheral surface speed of the fabric winding roll remains substantially equivalent to the speed of the peripheral contact roller as the fabric winding roll increases in diameter progressively over the course of the winding operation and, accordingly, it is not necessary to provide any regulation of the rotational speed of the fabric winding roll in relation to its progressively increasing diameter.

In a so-called rising or ascending batch winder, the fabric winding roll is arranged on a pair of support rollers arranged in horizontally adjacent parallel relation to one another with a traveling fabric web being supplied over one of the support rollers for winding application to the periphery of the fabric winding roll. Accordingly, in this type of winder, as in a surface-driven winder, the peripheral speed of the fabric winding roll naturally follows the speed of the support roller so that hereagain no need exists for regulating the rotational speed of the fabric winding roll over the course of the progressive building of the roll. Such rising-type winders are typically utilized for winding relatively small fabric rolls and for winding fabric webs which are not sufficiently stable to withstand the relatively high stress of the peripheral driving contact roller in a surface-driven winder.

For winding relatively large rolls of knitted fabric and other relatively unstable fabric webs, a so-called center or axis-driven winder is commonly utilized, wherein driving of the fabric winding roll is accomplished by driving its axial core about which the fabric web is wound. As will be understood, this type of winder requires some means of regulating the driving rotational speed of the fabric winding roll over the course of the winding operation to progressively reduce the driven rotational speed of the fabric winding roll in relation to its progressively increasing diameter so that the peripheral speed of the roll is maintained substantially uniformly at the delivery speed of the traveling fabric web. With relatively sensitive fabrics, a separately driven conveyor roller is utilized for feeding the traveling fabric to the fabric winding roll. Such conveyor roller may be arranged for peripheral contact with the fabric winding roll or may be maintained at an approximately constant distance from the periphery of the fabric winding roll throughout the winding operation. In winders having both an axis-driven fabric winding roll and a separately driven conveyor roller in peripheral contact with the fabric winding roll, some means must be provided to maintain the contact pressure between the conveyor roller and the fabric winding roll approximately constant during the winding operation.

Instead of fabric winding machines, so-called cuttlers may be utilized as a fabric web delivery apparatus, wherein a fabric guide arm is driven in a back-and-forth oscillating motion to fold a traveling fabric web in a cuttled, i.e. pleated, fashion.

West German published patent application No. 20 61 888 discloses a "universal" apparatus for winding textile fabric webs which can be manipulated to operate either as a rising-type winder, a surface-driven winder, or a center-driven winder. This apparatus provides a pair of arm members joined by an articulated connection enabling the arm members to be fixed in any desired position with respect to one another, with one arm member being mounted in a machine frame and the other arm member supporting a drive means together with bearing components to accept either a contact roller or a fabric winding core.

Thus, for operation of the apparatus as a rising-type winder or as a surface-driven winder, a contact roller is mounted on the second arm for driven operation. In this manner, the contact roller may function in conjunction with another roller, e.g. a withdrawal roller of a preceding textile machine such as a tenter drier, to provide a pair of support rollers for operation as a dual-roller rising batch winder. On the other hand, the contact roller may be arranged in peripheral driving engagement with a fabric winding roll for operation as a surface-driven winder to enable the production of relatively large diameter fabric rolls.

On the other hand, for operation of such apparatus as a center-driven winder, the contact roller is replaced by a fabric winding core for driving operation thereof for winding of a traveling fabric web directly about the core. As will be understood, an additional contact roller should be utilized in this case for delivering the traveling fabric web to the core and, as necessary or desirable, the contact roller may be equipped with its own drive for operation of the apparatus as a combined center and surface driven winder. As will further be understood, some regulator means is necessary for controlling the driving of the fabric core as a function of the speed at which the traveling fabric web is fed.

The universal winding apparatus as above-described has several disadvantages. First, the articulable arms of the apparatus must have a sufficiently stable design and mounting to be capable of supporting a fully wound fabric roll. Further, an additional conveyor roller with another pivot arm is still required to enable operation of the apparatus as a center-driven winder. Finally, the apparatus is still incapable of conversion for cuttling operation to fold a fabric web in a pleated manner.

SUMMARY OF THE INVENTION

The present invention, in contrast, provides a fabric web delivery apparatus capable of alternative operation as a surface-driven fabric winder and as a fabric cuttler and, in the preferred embodiment, for selective operation additionally as either a rising-type fabric winder or a center-driven fabric winder.

Briefly summarized, the apparatus of the present invention comprises a frame, a delivery arm pivotably mounted on the frame, a driven delivery roller rotatably supported on the delivery arm at a spacing from its pivoted mounting, and a cuttle arm mounted to the frame for reciprocable cuttle motion independently of the delivery arm. The delivery arm is selectively pivotable to a first position adapted for peripheral driving contact with a fabric winding roll of a surface-driven fabric winder for driving the fabric winding roll while applying the traveling fabric web peripherally thereto to wind the fabric web thereabout. Alternatively, the delivery arm is selectively positionable at a second position adapted for feeding the traveling fabric web to the cuttle arm for folding the web in pleats.

In the preferred embodiment, the apparatus includes pivot means movably mounted to the frame for selective vertical positionability of the pivot means with respect to the frame, with the pivot means supporting the delivery arm for pivotable movement with respect to the frame. By vertical adjustment of the pivot means, the delivery arm is selectively positionable at a third position adapted for operation of the delivery roller as a fabric guide for delivering the traveling fabric web to a fabric winding roll of an axis-driven fabric winder and at a fourth position adapted for operation of the delivery roller as a support roller for a fabric winding roll of a rising-type fabric winder.

Preferably, the pivot means includes a slide member mounted to the frame for selective vertical slidability with respect thereto, with the delivery arm being pivotably supported on the slide member. A drive member is also mounted on the slide member at the pivot location of the delivery arm and is operably connected with a main drive means for driving the delivery roller. The main drive means is fixed with respect to the frame and includes an endless driven chain arranged for continuous driving engagement with the drive member through the full range of vertical sliding movement of the slide member. In this manner, the drive means ensures that the delivery roller may be driven in the same manner at all elevations to the delivery arm pivot means.

In the fourth position of the delivery arm, the delivery roller is disposed for arrangement in adjacent parallel relation with a fabric discharge roller of a preceding textile machine from which the traveling fabric web is discharged, whereby the delivery and discharge rollers may cooperate as support rollers in the manner of a rising-type fabric winder. The vertical adjustability of the pivot means enables the delivery roller to be positioned horizontally adjacent the discharge roller for normal winding operation and, alternatively, to be positioned at a slightly lower elevation than the discharge roller for ejection of a fully-wound fabric roll.

According to the present invention, the cuttle arm is mounted separately on the machine frame for reciprocated cuttling operation only when the delivery apparatus is used as a cuttler for folding a fabric web, the cuttle arm being pivotable into a non-operating reserve position when the apparatus is utilized as a winder. In contrast, the delivery arm with its delivery roller is utilized in each application of the delivery apparatus, whether for fabric winding or cuttling. Advantageously, only pivotal movement of the delivery arm is required for movement between its first and second positions for operation, respectively, as a surface-driven winder and as a feed for a cuttling operation and, by cooperative pivoting and vertical adjustment of the delivery arm, it can be easily moved also to its third and fourth positions for operation, respectively, as part of a centerdriven winder or a rising-type batch winder. When used for a center-driven winding operation, the delivery roller may be selectively arranged in peripheral contact with the fabric winding roll or may be regulated so as to maintain a uniform distance from the periphery of the fabric roll and, as necessary or desirable, the delivery roller may still be driven.

In order for the delivery roller when used in a center-driven winder to remain at a constant relative elevation with respect to the axis of the fabric winding roll or to maintain the delivery roller at a uniform spacing from the periphery of the fabric winding roll, the fabric winding roll is moved in a direction away from the delivery roller as the diameter of the fabric winding roll progressively increases. For this purpose, a detection device is preferably provided to detect deflections of the delivery arm responding to the increasing diameter of the fabric winding roll. Thus, as the fabric winding roll increases in diameter, the detection device initiates movement of the supporting structure of the driven fabric winding roll in a direction away from the delivery roller so that a uniform distance is maintained between the delivery roller and the periphery of the fabric winding roll or a uniform contact pressure is maintained therebetween.

Advantageously, all pivot motions of the delivery arm of the present invention may be accomplished utilizing a piston-and-cylinder actuating arrangement and, similarly, all vertical linear motions of the delivery arm may be accomplished utilizing the aforementioned slide member arrangement. An important feature of the delivery apparatus of the present invention is that a single delivery arm is sufficient for function of the delivery apparatus as a cuttle motion and as either a surface-driven winder, a center-driven winder or a rising-type batch winder.

DESCRIPTION OF THE PREFERRED EMBODIMENT

Figure 1:
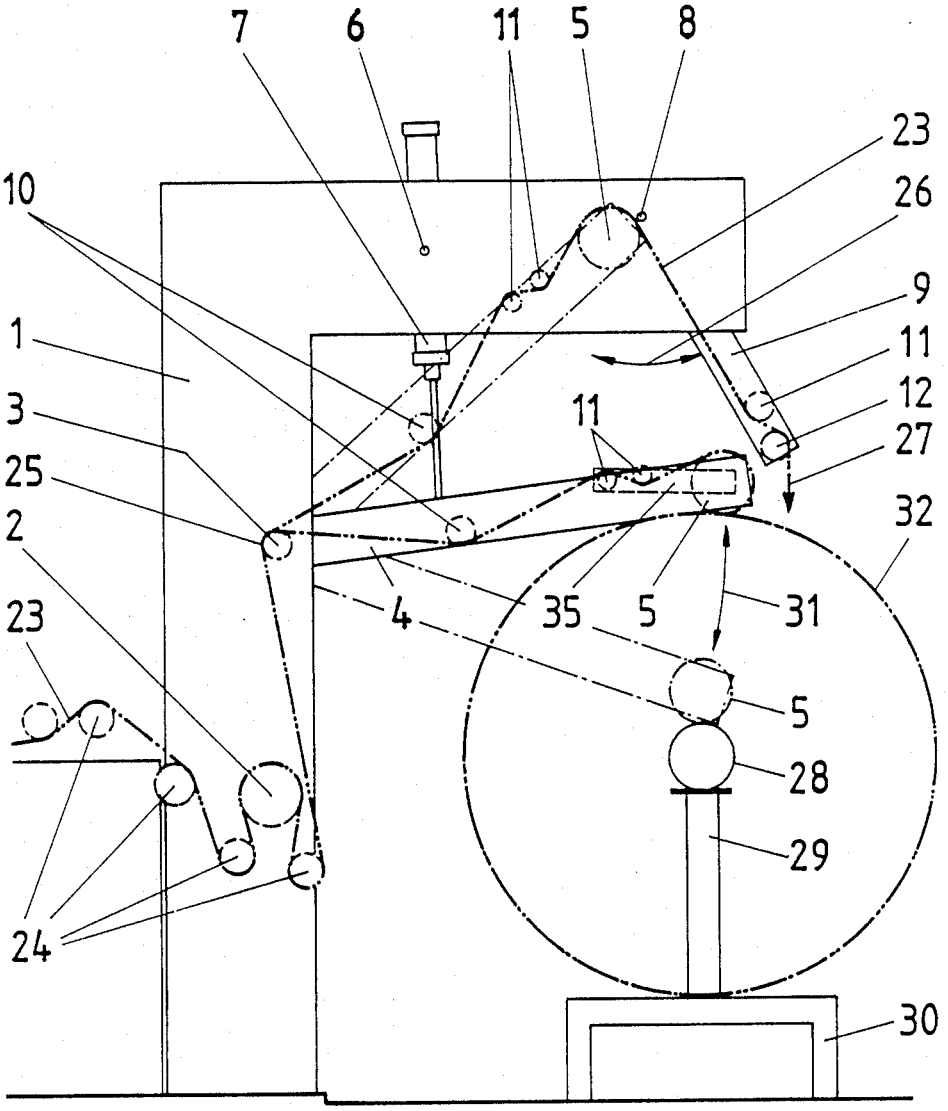
FIG. 1 is a schematic side elevational view of a fabric web delivery apparatus according to the preferred embodiment of the present invention, illustrating the apparatus as arranged for optional use as a surface-driven winder or as a cuttle motion.
Figure 2:
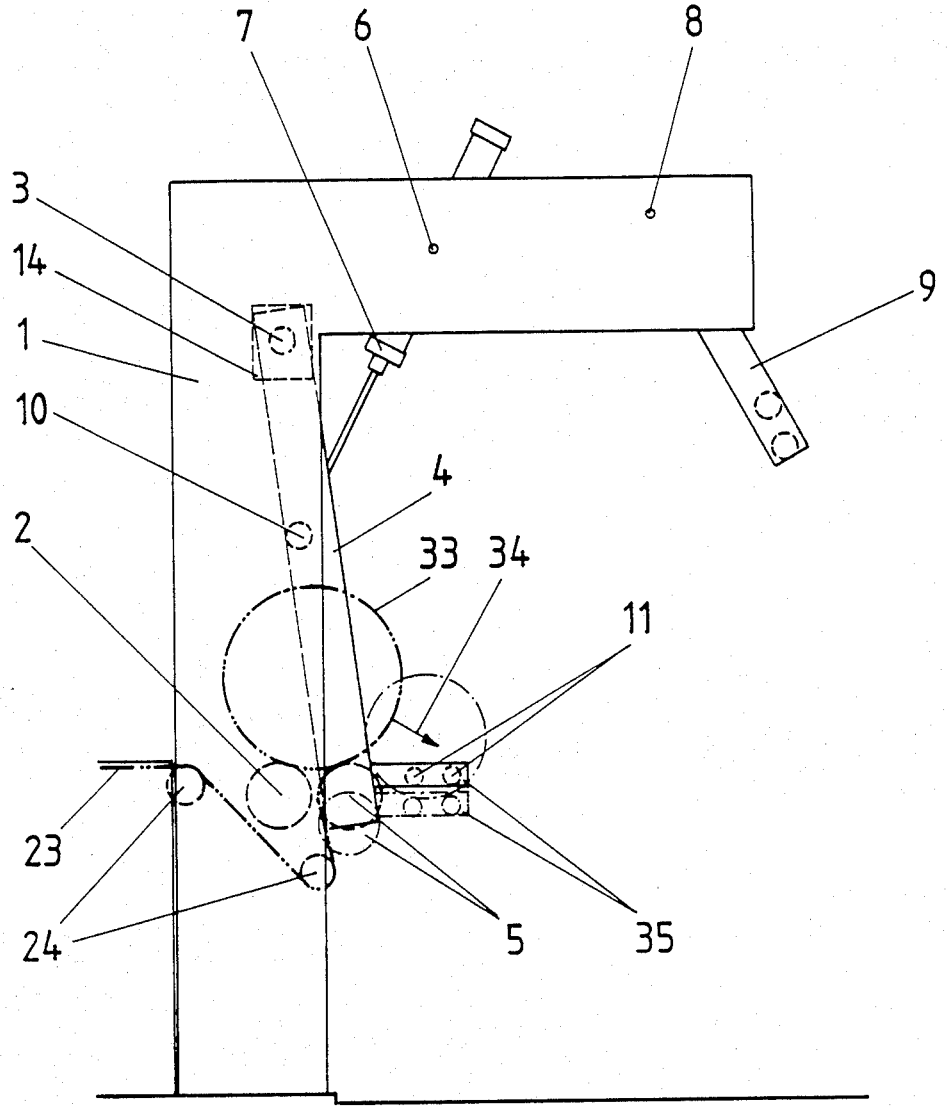
FIG. 2 is another schematic side elevational view of the delivery apparatus of FIG. 1 as arranged for use as a dual-roller rising batch winder.
Figure 3:
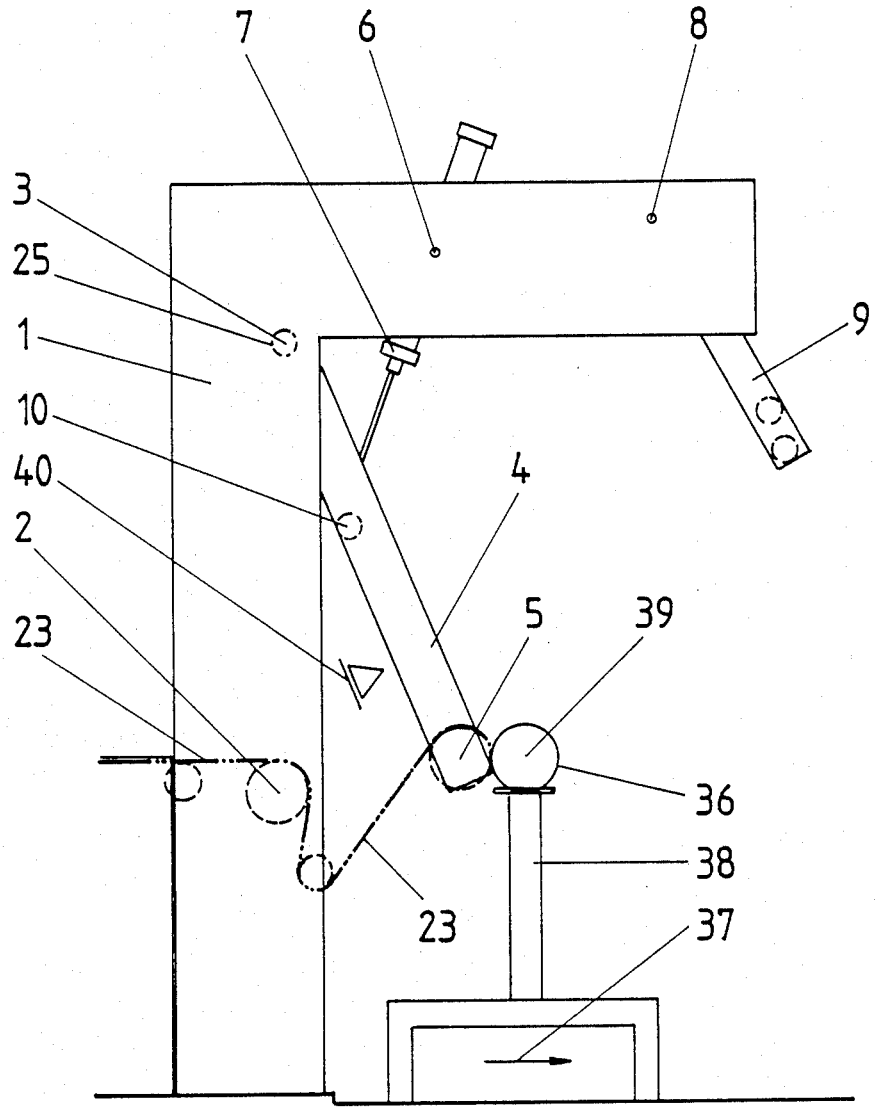
FIG. 3 is another schematic side elevational view of the delivery apparatus of FIGS. 1 and 2, as arranged for use in a center-driven winding operation.

Referring now to the accompanying drawings and initially to FIGS. 1–3, the preferred embodiment of the fabric web delivery apparatus of the present invention is shown schematically in side elevation. Basically, the delivery apparatus includes an upstanding machine frame 1 as preferably arranged immediately adjacent a preceding textile web handling machine, a delivery roll 2 of which is illustrated. A delivery arm 4 is pivotably mounted at one end to the machine frame 1 about a pivot pin 3 and has a delivery roller 5 rotatably supported at the outward free end of the delivery arm 4. Preferably, the delivery arm 4 includes a pair of laterally-spaced arm members, only one of which is seen in side elevation as illustrated, with the delivery roller 5 as well as one or more guide and tension rollers 10, 11 extending laterally between the arm members. A pair of laterally-spaced piston-and-cylinder assemblies 7, only one of which is shown, are mounted pivotably on a horizontally-extending upper section of the machine frame 1 about a common pivot axis 6 with the extending ends of their respective pistons being affixed to the arm members of the delivery arm 4 for actuating pivotal movement thereof with respect to the machine frame 1. A cuttle arm 9 is pivotably mounted at the outward end of the upper horizontally-extending section of the machine frame 1 for reciprocable cuttle motion independently of the delivery arm 4. The cuttle arm 9 is of a similar construction to the delivery arm 4, having a pair of parallel laterally spaced arm members pivoted about the common axis 8 and supporting one or more guide and tension rollers 11, 12 also referred to as a conveyor roller pair, between the arm members.

Figure 4:
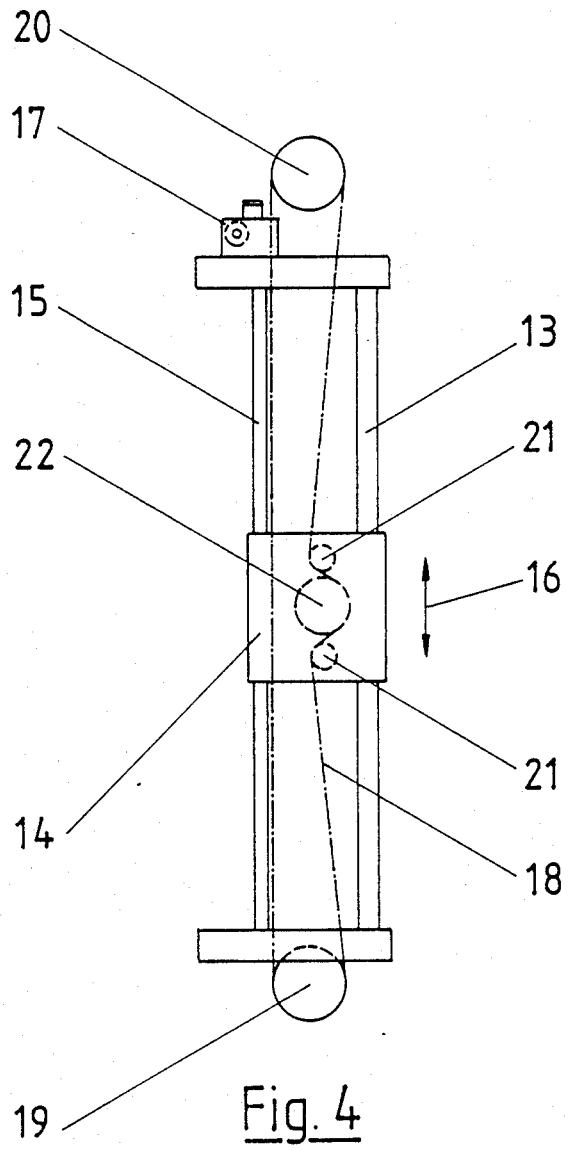
FIG. 4 is a side elevational view of the preferred form of slide mechanism for vertical adjustment of the elevation of the delivery arm of the present fabric web delivery apparatus of FIGS. 1–3.

The pivot pin 3 of the delivery arm 4 is mounted between a pair of slide mechanisms, only one of which is depicted in FIG. 4, which are mounted in parallel laterally-spaced relation at opposite sides of the machine frame 1 for actuating vertical movement of the delivery arm 4 upwardly and downwardly with respect to the machine frame 1. As seen in FIG. 4, the pivot pin 3 is rotatably supported by a slide member 14 of each slide mechanism, the slide member 14 being slidably mounted on a vertically-arranged slide rail 13 and being threadedly mounted to a parallel vertically arranged screw spindle 15 driven by a suitable drive mechanism 17 for actuating upward and downward sliding movement of the slide member 14 along the slide rail 13 as indicated by directional arrow 16. A drive gear 22 is supported on the slide member 14 coaxially with the pivot pin 3 for driving the delivery roller 5 through a suitable drive connection (not shown) extending along the delivery arm 14. The drive gear 22 is driven by an endless chain 18 trained about a main drive mechanism 19 and an idler chain wheel 20 fixedly mounted in vertically spaced relation along the upstanding extent of the machine frame 1 adjacent upper and lower ends of the slide mechanism, the chain 18 being trained in driving relationship with the drive gear 22 by a pair of auxiliary gear wheels 21 mounted on the slide member 14 adjacent opposite upper and lower sides of the drive gear 22. In this manner, the drive gear 22 is maintained in driven relationship to the main drive mechanism 19 at all elevations of the slide member 14 for driving the delivery roller 5 in all vertical dispositions of the delivery arm 4.

As shown in FIG. 1, a traveling fabric web 23 is delivered from a preceding web handling machine over guide rollers 24 and a withdrawal roller 2 and then over a feed roller 25 coaxial with the pivot axis of the delivery arm 4. When the delivery arm 4 is pivoted into the upwardly extending position shown in broken lines in FIG. 1, the fabric web 23 travels over the delivery roller 5 at the free end of the delivery arm 4 and downwardly therefrom along the cuttle arm 9 and about its pair of conveyor rollers 11, 12. Thus, when the cuttle arm 9 is reciprocably pivoted back and forth about its pivot axis 8, as indicated by the directional arrow 26, during feeding of the traveling fabric web 23, the web 23 is delivered downwardly in the direction of the arrow 26 to a suitable receiving platform or surface placed on the floor for progressive folding of the fabric web 23 in a pleated cuddle fashion. It is contemplated that suitable means may be provided for coupling the driven delivery roller 5 with the cuttle arm 9 for driving its reciprocal motion.

Alternatively, the delivery arm 4 in its vertical disposition shown in FIG. 1 may be pivoted into an outwardly-extending position for peripheral driving contact of the delivery roller 5 with a fabric winding roll to function as a contact roller in the manner of a surface-driven fabric winder. As shown in broken lines in FIG. 1, the delivery arm 4 extends at the beginning of the winding operation at a slightly downward disposition with the delivery roller 5 in peripheral contact with a winding core 28 rotatably mounted on a winding frame only diagrammatically shown in FIG. 1 as having an upstanding support 29 extending from a floor-mounted carriage 30. In operation, the driven delivery roller 5 peripherally drives the core 28 to begin the winding operation and continues to peripherally drive the fabric winding roll 32 while applying the traveling fabric web 23 peripherally thereto to wind the fabric web thereabout. As the fabric roll 32 gradually builds, the delivery arm 4 and the delivery roller 5 are gradually elevated, as indicated by directional arrow 31, with the piston and cylinder assemblies 7 serving to exert a substantially uniform force on the delivery arm 4 to maintain the delivery roller 5 in uniform driving contact with the periphery of the roll 32 throughout the winding operation.

In FIG. 2, the delivery arm 4 is shown in a substantially downwardly extending disposition actuated by elevation of the slide mechanism 14 and substantially full extension of the piston and cylinder assemblies 7, wherein the delivery roller 5 is disposed in substantially horizontally-adjacent parallel relation to the withdrawal roller 2 of the preceding web-handling machine for cooperation of the withdrawal and delivery rollers 2, 5 to function as a dual-roller rising batch winder. In such parallel horizontally adjacent disposition of the withdrawal and delivery rollers 2, 5, a fabric winding roll 33 may be supported in conventional fashion peripherally between the rollers 2, 5, with the driven delivery roller 5 being operable to rotatably drive the fabric winding roll 33 while peripherally applying the traveling fabric web 23 thereto to wind the fabric web thereabout. When the fabric winding roller 33 is fully wound, the roll 33 may be removed from the supporting withdrawal and delivery rollers 2, 5 by actuating the slide 14 to slightly lower the delivery arm 4 to dispose the delivery roller 5 at a slightly lower elevation than the withdrawal roller 2, as shown in FIG. 2 in broken lines, to permit the fully-wound fabric roll 33 to be ejected in the direction of the arrow 34. In order to prevent an uncontrolled drop of the fully-wound fabric roll 33, the delivery arm 4 may be provided with an outwardly-pivotable roll receiver arm 35 on which tension rollers 11 are mounted, whereby the fabric roll 33 is received and supported on the rollers 11 upon ejection from the support rollers 2, 5.

FIG. 3 depicts the delivery arm 4 in an angularly downwardly-extending disposition for operation of the delivery roller 5 for feeding the traveling fabric web 23 peripherally to the core 36 rotatably and drivenly supported on the frame of a center-driven winder, diagrammatically shown at 38. As seen, in this disposition the slide mechanism for the delivery arm 4 is substantially elevated with the piston and cylinder assemblies 7 being extended sufficiently to position the delivery roller 5 substantially horizontally adjacent and parallel to the core 36. The winder frame 38 of the center-driven winder is preferably supported on a movable carriage for traveling movement in the direction of the arrow 37 and is provided with a variable drive mechanism to enable the axial rotational speed of the core 36 to be progressively reduced as the windings of the fabric web 23 about the core 36 build in diameter so as to maintain the peripheral speed of the fabric winding roll substantially equivalent to the speed at which the traveling fabric web 23 is fed. The delivery roller 5 may also be driven, as desired, to provide a combined axial and peripheral drive from the fabric winding roll.

As will be understood, in the operation of the present apparatus with a center-driven winder as shown in FIG. 3, the delivery roller 5 may either be disposed in continuous peripheral contact with the fabric winding roll or maintained at a slight uniform distance from the periphery of the roll throughout the winding operation. In either case, it is desirable to maintain the delivery roller 5 at substantially the same elevation relative to the axis 39 of the fabric winding roll as the roll increases in diameter over the course of the winding operation. In order to do so, the center-driven winding frame 38 may be moved progressively away from the delivery roller 5 as the diameter of the fabric winding roll increases. For this purpose, the present apparatus is preferably provided with a detector, only representatively indicated at 40, adapted to sense deflection of the delivery arm 4 in response to the increasing diameter of the fabric winding roll, with the detector 40 being arranged in operative relationship with the winder frame 38 to actuate movement thereof in the direction 37 away from the delivery roller 5 so as to maintain a uniform spacing between the delivery roller 5 and the periphery of the fabric winding roll or to maintain a uniform contact pressure of the delivery roller 5 peripherally against the fabric winding roll.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is into intended or to be construed to limit the present invention or otherwise to exclude any such other embodiment, adaptations, variations, modifications and equivalent arrangements, the present invention being limited only by the claims appended hereto and the equivalents thereof.

We claim:

1. Apparatus for delivering a traveling fabric web to a web-handling location for winding or folding of the web, said apparatus comprising a frame, a delivery arm pivotably mounted on said frame, a driven delivery roller rotatably supported on said delivery arm at a spacing from its pivoted mounting, and a cuttle arm mounted to said frame for reciprocable cuttle motion independently of said delivery arm, said delivery arm being selectively pivotable to a first position for peripheral driving contact with a fabric winding roll of a surface-driven fabric winder for driving said fabric winding roll while applying the traveling fabric web peripherally thereto to wind the fabric web thereabout and a second position feeding the traveling fabric web to said cuttle arm for folding the web in pleats.

2. Apparatus for delivering a traveling fabric web to a web-handling location according to claim 1 and characterized further by pivot means movably mounted to said frame for selective vertical positionability of said pivot means with respect to said frame and supporting said delivery arm for pivotable movement with respect to said frame, said delivery arm being selectively positionable at a third position adapted for operation of said delivery roller as a fabric guide for delivering the traveling fabric web to a fabric winding roll of an axis-driven fabric winder and at a fourth position adapted for operation of said delivery roller as a support roller for a fabric winding roll of a rising fabric winder.

3. Apparatus for delivering a traveling fabric web to a web-handling location according to claim 2 and characterized further in that said pivot means includes a slide member mounted to said frame for selective vertical slidability with respect thereto, said delivery arm being pivotably supported on said slide member, and said pivot means further includes a drive member mounted on said slide member at the pivot location of said delivery arm and operably connected with a main drive means for driving said delivery roller.

4. Apparatus for delivering a traveling fabric web to a web-handling location according to claim 3 and characterized further in that said main drive means is fixed with respect to said frame and includes an endless driven chan arranged for continuous driving engagement with said drive member through the full range of vertical sliding movement of said slide member.

5. Apparatus for delivering a traveling fabric web to a web-handling location according to claim 2 and characterized further in that said delivery arm is positionable in said fourth position with its said delivery roller in adjacent relation with a fabric discharge roller of a preceding machine for cooperation of said delivery and discharge rollers as support rollers of a rising fabric winder.

6. Apparatus for delivering a traveling fabric web to a web-handling location according to claim 5 and characterized further in that said pivot means is adapted for vertical adjustability of said delivery roller with respect to said discharge roller for operative disposition of said delivery roller horizontally adjacent said discharge roller and for disposition of said delivery roller at a lower elevation than said discharge roller for ejection of a fully-would fabric roll.

* * * * *